United States Patent [19]

Shimizu

[11] 4,117,657

[45] Oct. 3, 1978

[54] ELECTRONIC TIMEPIECE CALENDAR CIRCUIT

[75] Inventor: Eisaku Shimizu, Suwa, Japan

[73] Assignee: Kabushiki Kaisha Suwa Seikosha, Tokyo, Japan

[21] Appl. No.: 748,866

[22] Filed: Dec. 10, 1976

[30] Foreign Application Priority Data

Dec. 10, 1975 [JP] Japan ..... 50-147001

[51] Int. Cl.[2] ..... G04B 19/24

[52] U.S. Cl. ..... 58/4 A; 58/85.5; 58/58

[58] Field of Search ..... 58/4 A, 58, 85.5

[56] References Cited

U.S. PATENT DOCUMENTS 3,961,472 6/1976 Riehl ..... 58/58

*Primary Examiner*—Robert K. Schaeffer
*Assistant Examiner*—Leonard W. Pojunas, Jr.
*Attorney, Agent, or Firm*—Blum, Moscovitz, Friedman & Kaplan

[57] ABSTRACT

An electronic timepiece calendar circuit whereby the display of at least the date is automatically effected during both leap years and non-leap years is provided. The electronic timepiece calendar circuitry includes a date counter that is indexed by a count of one from a count of one to at least 31 and thereafter is returned to a count of one to begin counting the dates of the next month. A month counter is provided for being indexed by one through a count of one to at least 12 each time the date counter is returned to a count of one and further is adapted to produce a signal representative of the count thereof. A control circuit is provided for receiving the month signal produced by the month counter and in response thereto returns the count of the day counter to one when the count of the month counter is two and the date counter is changed from 28 to 29 or from 30 to 31 depending on whether a leap year signal is applied thereto. The leap year signal is produced by year circuitry including a first year counter adapted to be indexed through a counting cycle of one to nine and a ten year counter series connected to the year counter that is adapted to be indexed through at least one odd and even counting cycle in response to each return of the month counter to a count of zero. A judging circuit is provided for detecting when the count of the year counter is zero, four and eight and the count of the 10 year counter is even, or alternatively, when the count of the year counter is two or six and the count of the 10 year counter is odd, and in response to detecting either alternative, applying a leap year signal to the control circuit.

14 Claims, 3 Drawing Figures

ELECTRONIC TIMEPIECE CALENDAR CIRCUIT

BACKGROUND OF THE INVENTION

This invention is directed to an electronic timepiece calendar circuit, and in particular, to the automatic display of calendar information, such as date, month and year, by an electronic timepiece, without having to effect correction of the calendar circuitry at the end of each month or year.

Heretofore, mechanical wristwatches provided with calendar displays, have generally required that the wearer of the electronic timepiece, if same is a wristwatch, manually adjust the calendar wheel to a count of one after months such as February, April, June and November, that have less than 31 days. Although highly complex mechanical display calendar arrangements have been provided for eliminating this problem in mechanical watches, same have been found to be highly complicated and particularly large, thereby preventing their wholesale adoption in mechanical movement wristwatches having calendar mechanisms.

With the changeover from mechanical movement timepieces to fully electronic timepieces, and in particular, to digital display electronic timepieces of the LCD and/or LED type, electronic timepiece calendar displays that provide for automatic return of the date at the end of each month, without adjustment, have been suggested. Specifically, the date displayed by the calendar is automatically returned to a count of one after each 31 day month is automatically returned to a count of one after each 30 day month, and, after February, is returned to a count of one after 28 days. This arrangement however does not take into account the requirement that the date counter not be returned to a count of one during leap years until after the 29th day of the month. Accordingly, a timepiece that is not capable of detecting when a year is a leap year, requires mechanical adjustment of the timepiece at the end of February during each leap year, thereby requiring the complex mechanical manipulations that obtain in electronic wristwatches when correction of the time displayed by the counters needs to be corrected. Therefore, a leap year counter and judging circuit for permitting the year to be displayed and for effecting automatic adjustment of the date displayed over a period of at least 20 years, is provided.

SUMMARY OF THE INVENTION

Generally speaking, in accordance with the instant invention, an electronic timepiece calendar circuit for automatically displaying date information over a lengthy period of years without requiring manual adjustment is provided. Calendar circuitry includes year counter circuitry for producing a signal representative of a leap year and further includes a date counter for receiving a clock pulse having a period of one day and in response to each clock pulse received thereby, being adapted to be indexed through a counting cycle from one to at least 31 and thereby produces a date signal representative of the count thereof. A month counter detects each return of the date counter to a count of one and in response thereto, is indexed by one through a counting cycle from one to at least 12 and produces a month signal representative of the count thereof. Control circuitry receives the month signal and date signal and when the month signal is representative of a count of two, the control circuitry, in the absence of a leap year signal applied thereto, effects a return of the date counter to a count of one in response to detecting when the count of the day counter is changed from 28 to 29, the control circuitry being further adapted, in response to the presence of a leap year signal applied thereto, to return the count of the date counter to one when the count of the date counter is changed from 29 to 30. The leap year producing circuitry is particularly characterized by a year counter adapted to be indexed by a count of one through a counting cycle from zero to nine and produces a year signal representative of the count thereof. A ten year counter is series connected to the year counter and is cycled at least through one odd and even counting cycle in response to each return of the count of the year counter to zero and further produces a ten year signal representative of the count thereof. Judging circuitry is provided for detecting the year signal and ten year signal and in response to detecting either the year signal having a count of zero, four or eight, and the 10 year signal having an even count, or alternatively, the year signal having a count of two and six and the ten year signal having an odd count, applying a leap year signal to the control means to thereby effect a return of the count of the date counter to one, when the count of the month counter is two, and the date counter is changed from a count of 29 to 30.

Accordingly, it is an object of this invention to provide an improved electronic timepiece perpetual calendar circuit.

Another object of the instant invention is to provide an improved electronic timepiece calendar circuit that effects automatic adjustment of the date display to display the first day of the month after months having 28 days, 29 days, 30 days and 31 days.

Still a further object of the instant invention is to provide an improved electronic timepiece calendar circuit that provides for the perpetual automatic display of the date and month without requiring manual adjustment, unless normal operation of the timepiece is interrupted.

Still another object of the instant invention is to provide an electronic timepiece calendar circuit that provides for the display of date, month and year information for a period of at least twenty years.

It is still a further object of the instant invention to provide an improved electronic timepiece calendar circuit wherein correction of the calendar information to be displayed is easily effected.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
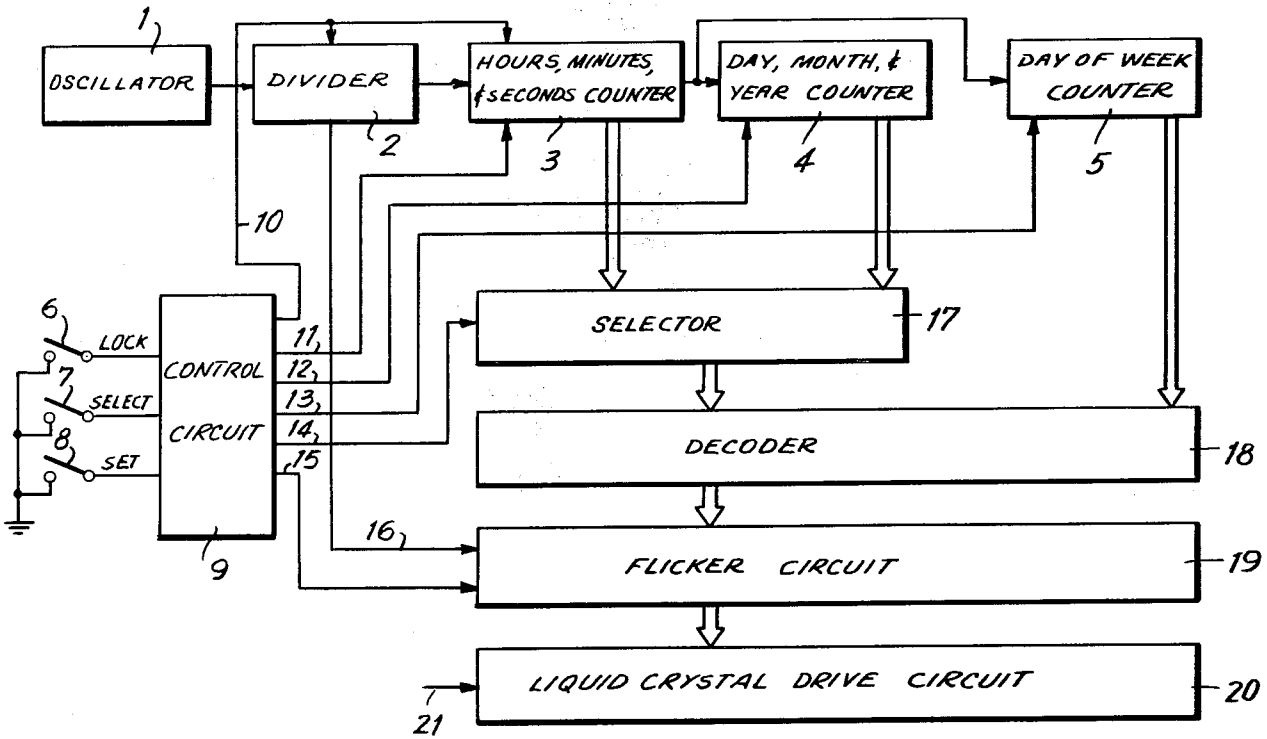
FIG. 1 is a block circuit diagram of an electronic timepiece including a electronic calendar circuit constructed in accordance with a preferred embodiment of the instant invention.
Figure 2:
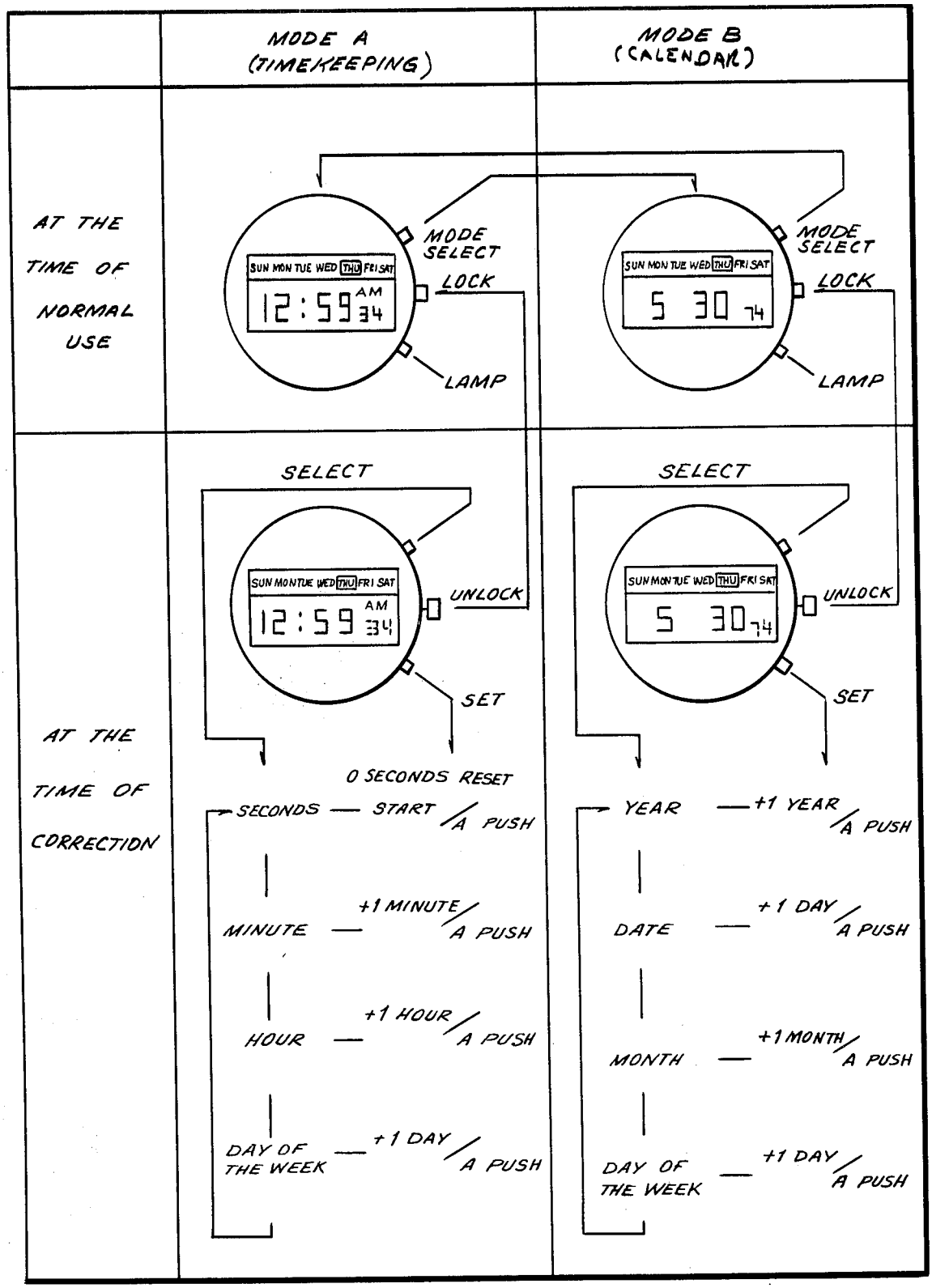
FIG. 2 is a comparison illustration of the manner in which correction of the time display, when the timepiece is in a timekeeping mode, and correction of the calendar display, when the timepiece is in a calendar mode, is effected.

Reference is now made to FIGS. 1 and 2, wherein an electronic timepiece including timekeeping circuitry and calendar circuitry, and an illustrative comparison of the manner in which correction is effected, when the timepiece is displaying time-keeping or calendar information, are respectively depicted. Referring further to FIG. 1, a high frequency time standard signal is produced by an oscillator circuit 1, preferably utilizing a quartz crystal vibrator as a time standard, in order to obtain a highly stable and high frequency signal. A divider circuit 2 in response to receiving the high frequency time standard signal produced by the oscillator circuit 1, is coupled to an hours, minutes and seconds counter circuit 3, which circuit includes an hours counter, 10 hour counter, minutes counter, 10 minutes counter, seconds counter and ten seconds counter (now shown) for producing timekeeping signals representative of the hour, minute and second, and applies same to a selector circuit 17. Series coupled to the hours, minutes and seconds counter circuit 3 is a day, month and year counter circuit illustrated in greater detail in FIG. 3, for producing calendar signals representative of date, month and year calendar information, which signals are also applied to selector circuit 17. Also, a day of the week counter 5 is coupled to the hours, minutes and seconds counter circuit and in response to the count of the hours counter provides a day signal representative of the day of the week, which signal is applied to a decoder circuit to be digitally displayed. The selector circuit 17 receives the timekeeping signals produced by the hours, minutes and seconds counter 3 and also the calendar signals produced by the day, month and year counter 4, and selects a first timekeeping mode A or a second calendar mode B, whereby either the timekeeping signals or calendar signals are applied to decoder circuit 18. Accordingly, either the timekeeping signals and day of the week signal, or alternatively, the calendar signals and day of the week signal are applied through a flicker circuit 19 to a liquid crystal drive circuit for a display representative of the count of the respective timekeeping, calendar and day signals to be effected. To this end, a liquid crystal drive signal 21 is applied to the liquid crystal drive circuit 20 for effecting a digital display in a conventional manner. The selection of the timekeeping mode A or calendar mode B by the selector circuit 17 is effected in response to a signal 14 being applied thereto by a switching control circuit 9.

Specifically, when control circuit 9 is in a locked position, whereby the manually operated switch 6 coupled thereto is in an open position, as illustrated in FIG. 1, each pushing of the manually operated switch 7, coupled to the control circuit 9, will change the display mode of the selector circuit 17. Accordingly, if the timekeeping information is being displayed, and manually operated switch 7 is actuated, the selector will stop applying the timekeeping signal to the decoder circuit 18, and instead, will begin applying the calendar signals to the decoder 18, in order to effect a display of the date, month and year. Thereafter, another push of the manually operated select switch 7 will, once again, return the selector circuit 17 from calendar mode B to timekeeping mode A, in order to once again permit display of timekeeping information.

Referring specifically to FIG. 2, a comparison of the operation of the electronic timepiece depicted in FIG. 1, when same is in a timekeeping mode A and calendar mode B, is illustrated. In mode A, seconds, minutes, hours and the day of the week are displayed (THU-AM-12:59'34). However, in mode B, the day, date, month and year are displayed (THU-May 30, '74). When the timepiece is in normal use, manually operated lock switch 6 remains open, thereby preventing correction of the time displayed by the timepiece. As aforenoted, when the lock switch 6 is in a locked condition, the manually operated select switch 7 changes over the selector circuit 17 to dispose the timepiece into a timekeeping mode A or calendar mode B, of the type illustrated in FIG. 2. The manually operated set switch 8 is also coupled to control circuit 9, and when lock switch 6 is in a locked condition, the set switch is utilized to energize a lamp (not shown) in order to permit the liquid crystal display to be illustrated in the dark. Finally, as illustrated in FIG. 2, the day of the week is displayed whether the timepiece is in timekeeping mode A or calendar mode B.

When the timepiece, illustrated in FIG. 1, is in timekeeping mode A, and correction of the time being displayed thereby is needed, if the manually operated lock switch 6 is pulled, correction of the time displayed can be effected. When the lock switch is first pulled out, the flicker circuit applies a flicker signal 16, which signal is an intermediate frequency signal produced by the divider circuit, to the seconds display digits, so that the display of seconds is flickered. Accordingly, while the seconds digits are flickered, actuation of the manually operated select switch 7, by effecting a pushing thereof, results in control signal 11 being applied to the seconds counters in the hours, minutes and seconds counter circuit 3 to thereby reset the seconds counter to zero and immediately permit same to begin counting from zero seconds. Accordingly, when the seconds digit is flickering, a push of the manually operated set switch 8 will effect a setting of the count of the seconds counter to zero and an immediate restarting of same.

Thereafter, a push of manually operated select switch 7 will dispose the flicker circuit 19 to receive the minutes time-keeping signals and thereby effect a flickering of the minutes display digits. While the minutes digits are being flickered, a push of the manually operated set switch 8 will effect an indexing of the count of the minutes counter by one, to thereby permit correction of the minutes digit to the number desired. A further push of the manually operated select switch 7 will index the flicker circuit to thereby flicker the hours digits, whereafter, the hours counter in the hours, minutes and seconds counter circuit 3 will be indexed by one for each push of the manually operated set switch 8, as long as the hours digit continues to be flickered. A further push of the manually operated select switch 7 will index the flicker circuit and thereby effect flickering of the day of the week display, so that each pushing of the manually operated set switch 8 will index the day displayed by one for each push thereof. Finally, a further pushing of manually operated select switch 7 results in a return of the flicker circuit to flickering the seconds digits, to thereby effect correction of the seconds digits in the manner described above.

Accordingly, correction of the timepiece when same is in a timekeeping mode A, whereby timekeeping information is displayed, is particularly characterized by the flickering of the seconds display in response to the lock switch being disposed in an unlocked position, and is further characterized by the control circuit 9 cyclically selecting the seconds digits, minutes digits, hours digits, day of the week display, in response to each actuation (push) of the manually operated select switch 7. Similarly, with the exception of the seconds display, which display is reset to zero and begins counting after each push of the manually operated set switch 8 when the seconds digit is flickered, each of the counters producing the timekeeping signals displayed during a timekeeping mode are indexed by one in response to each pushing of the manually operated set switch when the display digit corresponding to that counter is being flickered.

Additionally, as illustrated in FIG. 2, if the timepiece is in a calendar mode B, whereby calendar information is being displayed when the manually operated lock switch 6 is pulled-out, the year display is flickered by the flicker circuit 19. During the period of time that the year display digits are flickered, each actuation of manually operated set switch 8 effects an indexing of the count of the year counter in the day, month and year counter circuit 4 by a count of one. As in the timekeeping mode A correction, explained above, when the manually operated lock switch 6 is in an unlocked position, in response to each actuation of manually operated select switch 7, a cyclic indexing of the display digit to be flickered occurs, and hence the correction of the counter assiciated therewith can be effected. Specifically, after the year digits are flickered, the date digits, month digits, and day of the week digits, and once again, the year digits are flickered in sequence. Moreover, when the particular calendar display digits are being flickered, the operation of manually operated set switch 8 effects an indexing of the counters associated with the particular calendar display digits by a count of one, to thereby effect a correction of the information displayed thereby. For example, when the month display digits are being flickered, the count of the month counter in the day, month and year counter circuit 4 is indexed by a count of one for each push of manually operated set switch 8.

Thus, the electronic timepiece illustrated in FIG. 1 is particularly characterized by having two predetermined display modes, a timekeeping display mode A and a calendar display mode B, which modes are selected by actuation of a manually operated select switch when the timepiece is disposed in a locked condition by a manually operated lock switch. By such an arrangement, the same display digits utilized for displaying seconds, minutes and the year are respectively utilized to display the year, date and month, thereby reducing the number of display digits required. Moreover, by automatically effecting correction of the counters associated with the information being displayed, to wit, correction of the calendar information when the calendar information is displayed and correction of the timekeeping counters when the timekeeping information is displayed, an additional switch is eliminated. Moreover, by reducing the number of switches and display digits necessary, the timepiece is particularly suited to be reduced in size and utilized as an electronic wristwatch since wristwatches, unlike large table clocks, do not have a sufficient size to permit the display of timekeeping information and calendar information at the same time in sufficiently large digits to be readily recognized by the wearer.

Figure 3:
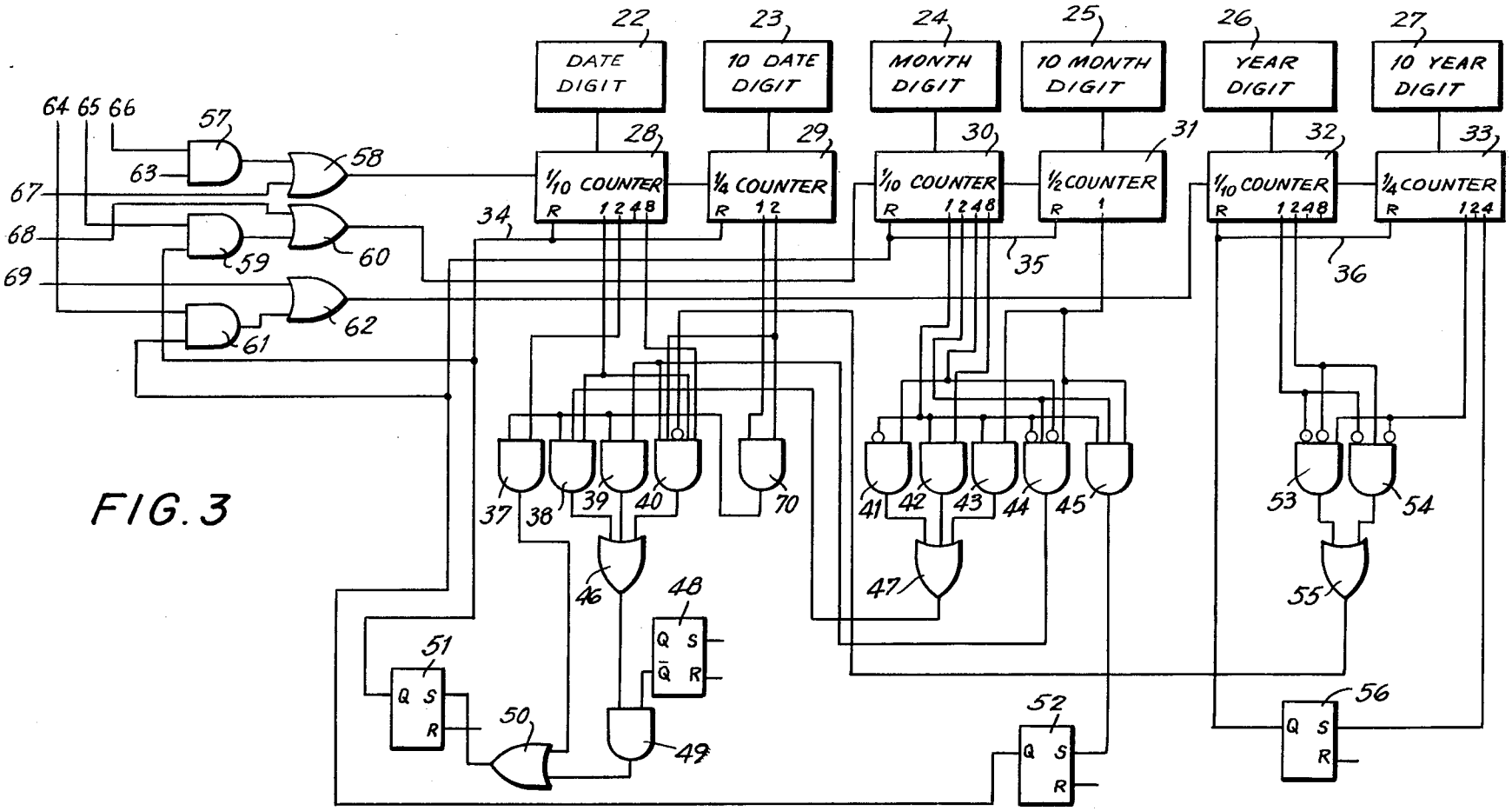
FIG. 3 is a circuit diagram of the electronic timepiece calendar circuit constructed in accordance with a preferred embodiment of the instant invention.

Reference is now made to FIG. 3, wherein the day, month and year counter circuit 4, illustrated in FIG. 1, and constructed in accordance with a preferred embodiment of the instant invention, is depicted. Day digit 22, 10-day digit 23, month digit 24, 10-month digit 25, year digit 26 and 10-year digit 27 represent the decoder circuitry, driving circuitry and liquid crystal display digits that are energized to display the count of the counters associated therewith, in response to the calendar signals produced by such counters. Specifically, 1/10 counter 28, $\frac{1}{4}$ counter 29, 1/10 counter 30, $\frac{1}{2}$ counter 31, 1/10 counter 32 and $\frac{1}{4}$ counter 33 are respectively coupled to day digit 22, 10-day digit 23, month digit 24, 10-month digit 25, year digit 26 and 10-year digit 27 to thereby apply thereto calendar signals, representative of the count of the respective counters. Each of the counters 28 through 33 include a reset terminal R for resetting the count of the respective counters to a predetermined count. For example, when reset signal 34 is applied to the reset terminal R of counters 28 and 29, counter 28 is set to a count of one and $\frac{1}{4}$ counter 29 is set to a count of zero. Similarly, when reset signal 35 is applied to the reset terminals R of 1/10 counter 30 and $\frac{1}{2}$ counter 31, counter 30 is reset to a count of one and counter 31 is reset to a count of zero. 1/10 counter 32 and $\frac{1}{4}$ counter 33 are respectively reset to a count of zero and a count of seven. The $\frac{1}{4}$ counter 33 and 1/10 counter 32 respectively function as the 10-year digit counter and year digit counter and accordingly, in response to a reset signal being applied thereto, are reset to a count of 70 to thereby produce a display representative of the year 1970.

In the preferred embodiment illustrated in FIG. 3, the years counter 32 and 10-years counter 33 effect a count of a 40-year period, which count is repeated in a cyclic manner starting with a count of 70 through a count of nine whereafter the count of the year counter and ten-year counter are reset once again to a count of 70. The calendar signals produced by each of the counters 28 through 33 is a BCD output, which output is adapted to energize the respective calendar display digits 22 through 27. Accordingly, the counts 28 through 33 are indexed by a count of one in response to each signal applied to the input thereof and are reset to the predetermined count, discussed above, in response to a reset signal being applied to the reset terminal R thereof.

In order to effect the automatic resetting of the counters 28 through 33, and thereby provide a electronic timepiece calendar circuit that need not be manually adjusted for a period of 40-years, unless it is necessary to change the battery or repair same, judging circuits are coupled to the respective BCD outputs of the counters 28 through 33 in order to receive signals representative of the count thereof. For example, AND gates 37 through 40 are utilized along with AND gate 70, to judge the BCD timekeeping outputs of 1/10 date counter 28 and $\frac{1}{4}$ 10-date counter 29. Specifically, AND gate 37 is utilized to judge when the count of the counters 28 and 29 is indexed to a count of 32. AND gate 38 is utilized to judge when the count of the counters 28 and 29 is indexed to 31. AND gate 39 is utilized to judge when the count of the counters 28 and 29 is indexed to 30 and AND gate 40 is utilized to judge when the count of counters 28 and 29 is indexed to a count of 29. Accordingly, AND gates 37 through 40 are utilized to detect the 32nd, 31st, 30th and 29th days, when same are counted by the date counter 28 and 10-date counter 29. Finally, AND gate 70 is coupled to the 10-date counter 29 and judges when the 10-date counter 29 is indexed to a count of 30 on the 30th day, a count of 31 on the 31st day and a count of 32 on the 32nd day.

AND gates 41 through 44 function similarly with respect to the 1/10 counter 30 for counting the month digit and ½ counter 31 utilized to count the 10-month digit. Specifically, AND gate 41 judges when the count of 1/10 counter 30 is four or six (April or May) to produce a signal representative of a thirty day month. AND gate 42 judges when the count of 1/10 counter 30 is 9 September, and applies a signal through OR gate 47 representative of a 30-day month to AND gate 38. AND gate 43 is coupled to 1/10 counter 30 and ½ counter 31 and detects when the count of the month counters is 11 November and applies a signal representative of a 30-day month to the AND gate 38. AND gate 44 is coupled to 1/10 counter and ½ counter 31 and detects when the count of same is two and applies a signal representative of the month of February to AND gates 39 and 40, respectively. Finally, AND gate 45 is coupled to 1/10 counter 30 and ½ counter 31 in order to detect when the count of the counters 30 and 31 utilized to produce a calendar display signal, representative of months, is indexed to a count of 13 and in response thereto applies a signal to the set terminal S of set-reset flip-flop 52. Thereafter, a reset clock signal is applied to the reset terminals R of flip-flop 52 and cause a reset signal 35 to be applied to the reset terminal R of the counters 30 and 31 and to reset the count of same to a count of one and thereby change the months display from the month of December to the month of January.

Leap year falls every four years, and accordingly, between the years 1970 and 2009, the leap years are 1972, 1976, 1980, 1984, 1988, 1992, 1996, 2000, 2004 and 2008. Accordingly, when the 10-year digit is in an even number, the year digits are zero, four and eight for each leap year. Alternatively, when the 10-year digit is an odd numbered year, the year digit is two or six in each leap year. Therefore, AND gates 53 and 54 are coupled to 1/10 counter 32 and ¼ counter 33 in order to judge when the 10-year digit is an even number or odd number, respectively. For example, when AND gate 53 judges that the 10-year digit of the leap year is even the count of year counter 32 is zero, four or eight, or alternatively, when AND gate 54 detects that a 10-year digit is odd and the count of year counter 32 is two or six, a leap year signal is applied through OR gate 55 to the input of AND gate 40, and thereby prevents the counter 28 and counter 29 from being reset to a count of one when the count thereof is indexed to 29.

The remaining elements in FIG. 3, not heretofore identified, will be explained in the context of the automatic operation of the electronic timepiece calendar circuit depicted in FIG. 3, or in the correction operation of the electronic timepiece calendar circuit depicted in FIG. 3. With respect to the former condition, namely, normal calendar operation of the electronic timepiece calendar circuit, in order to demonstrate how each of the counters 28 through 33 are advanced automatically, the end of the 40-year calendar display cycle is selected for purposes of explanation. Specifically, when the timekeeping and calendar counters of the timepiece are capable of producing timekeeping and calendar signals to be displayed for displaying PM-11:59, SUN 31, December, 09, when a carry signal 63 is produced at the output of the hours, minutes and seconds counter circuit 3 depicted in FIG. 1, the carry signal 63, assuming the gating input signal 66 to the AND gate 57 is HIGH, is transmitted through AND gate 57 and OR gate 58 and is applied to 1/10 counter 28 to thereby index the count thereof by one. Accordingly, counter 28 is indexed to a count of two. AND gate 37, coupled to BCD output 2 of counter 28 and the output of AND gate 70, detects when the count of counter 28 is two and counter 29 is three, and in response to the coincident binary "1" applied thereto, representative of the count of 32 in the respective counters 28 and 29, applies a binary "1" signal through OR gate 50 to the set terminals of set-reset flip-flop 51. Accordingly, a reset signal 34 is applied to reset terminals R of counters 28 and 29 upon the next application of a clock signal to the R terminal of set-reset flip-flop 51. The application of the reset signal 34 to the reset terminals R of counters 28 and 29 effects a setting of the count thereof to one in the manner described above. At the same time that reset signal 34 is applied to reset terminals R of counters 28 and 29, respectively, the reset signal 34 is also applied as a first input to AND gate 59. By referencing the other input 65 of the AND gate 59 to a binary "1" state, the reset signal is applied through AND gate 59 and OR gate 60 to the input of 1/10 counter 30 to thereby index the 1/10 counter 30 and ½ counter 31 by a count of one in response thereto.

When a count of one is added to counter 30, thereby providing a month count of 13, AND gate 45 detects the count of 13 and applies a binary "1" state signal to the set terminal S of set-reset flip-flop 52. Accordingly, in response to the next clock signal being applied to the reset terminal R of set-reset flip-flop 52, a binary "1" state reset signal 35 is applied to counters 30 and 31 to thereby reset the combined counts thereof to a count of one representative of the month of January. At the same time, the reset signal 35 is also applied to the first input of AND gate 61. Therefore, if the other input 64 of the AND gate 61 is referenced to a binary "1" state, the reset signal 35 is applied through OR gate 62 to the 1/10 counter 32 and ¼ counter 33 to thereby further index the counters utilized to count the year and 10-year digits and index the count thereof by one.

The counters 32 and 33 operate in the same manner discussed above with respect to the month counter 30 and 31 and date counters 28 and 29 and are indexed by a count of one in response to the reset signal being applied to the input thereof through OR gate 62. When the counter 32 is indexed by a count of one, a "1" signal is applied to the set terminal 56 of set-reset flip-flop 56, whereafter, a binary "1" signal 36 is applied at the output Q of the set-reset flip-flop 56 in response to the next application of a clock pulse to the reset terminal R of the set-reset flip-flop 56. Accordingly, in response to the reset signal 36 being applied to the reset terminal R of counters 32 and 33, counters 32 and 33 are reset to a count of 70. Therefore, about 1 second later, the calendar and timekeeping display information is changed from PM-11:56-SUN-31-December-09 to AM-12:00'00-MON-1-January-70.

Finally, with respect to the leap year detection effected by the judging circuits depicted in FIG. 3, in the month of February, during a leap year, a binary "1" state signal is applied at the output of OR gate 55 to the input of AND gate 40 through an inverter gate, to thereby inhibit any output of AND gate 40 when the count of counters 28 and 29 is indexed to a count of 29.

Instead, AND gate 39 detects, as a first input, the output of AND gate 70 representative of a count of 30 in the counter 29, and as a second input the output of AND gate 44, which AND gate detects when the count of counter 30 is two and in response thereto produces a signal when the counter 29 is first indexed to a count of three, to thereby reset the counters 28 and 29 producing the date calendar signals to a count of one at the end of the 29th day, when a leap year signal is produced at the output of OR gate 55.

Still a further feature of the electronic timepiece date circuit, depicted in FIG. 3, is the manner in which correction of the time displayed by the respective digits 22 through 27 by adjusting the counts of the respective counters associated therewith is effected. At the outset, when time correction is commenced, such as by unlocking the lock switch, a binary "0" signal is applied to the reset terminal of set-reset flip-flop 48. Thereafter, if manually operated set switch 8 is operated, a binary "1" state signal is applied to set terminal S of set-reset flip-flop 48, to thereby dispose the output Q at a HIGH binary level and the output Q' at a LOW binary level, thereby inhibiting the output of OR gate 46 from being applied through AND gate 49. Since the output from the OR gate 46 is inhibited, the counter will produce signals representative of a count of 31. Since the counters 28 and 29 will remain with a count of 31, nonexistent dates such as February 30, April 31, etc., will be displayed during the correction steps. However, when the manually operated lock switch is returned to a locked position, a HIGH level signal is automatically applied to the reset terminal R of set-reset flip-flop 48, thereby producing a HIGH level or binary "1" state signal at the output Q of flip-flop 48 to thereby permit the output of OR gate 46 to effect a resetting of counters 28 and 29. Therefore, at the time that the manually operated lock switch is returned to a locked condition, the date counters 28 and 30 are automatically corrected to the correct count (February 30 is changed to March 1, April 31 is changed to May 1, etc.) to thereby effect automatic correction of the date counters at the beginning of the month. Moreover, even if manually operated selection switch 7 is actuated when the lock switch is in an unlocked position, the number 31 is displayed, unless the manually operated set switch 8 is actuated.

Correction signals 67, 68 and 69 are respectively applied through OR gates 58, 60 and 62 to counters 28, 30 and 32 in response to an actuation of the manually operated set switch, when a predetermined calendar display digit is flickered. For example, if the month digits are being flickered, in the manner discussed above with respect to FIG. 1, to thereby signify correction of the calendar display of month information, each actuation of the manually operated set switch 8 will effect the application of a binary "1" state signal at the input 68 of OR gate 60, which signal will be applied to the input of counter 30 to thereby index the count thereof by one. Additionally, inadvertent correction of the wrong counters, when a signal is carried from the previous counter, is prevented by inhibit signals 64, 65 and 66. Accordingly, when correction of the calendar information is manually effected, application of a binary "0" state signal to two of the three AND gates 57, 59 and 61, prevents the inadvertent application of the carry signal to the counters not being corrected, since the other input to the respective AND gates 57, 59 and 61 is inhibited thereby.

It is noted that the preferred embodiment detailed above is directed to a year display spanning 40-years. Nevertheless, by detecting the odd and even years, at a minimum, 20-years of automatic date correction can be effected. Moreover, the year display can be extended to the year 2099, although such an extension of the span of years to be automatically detected is less practical than 40 years at this time. Moreover, although a divide by four counter could replace the year counting circuit, it is noted that leap year detection of the type described above would not be efficiently attained.

Accordingly, the instant invention is particularly characterized by utilizing the same display digits for displaying timekeeping and calendar information, and for judging a leap year and automatically effecting a resetting of the calendar display circuitry to March 1 after February 29 during each leap year. Thus, the instant invention is particularly characterized by an automatic electronic timepiece calendar circuit that requires no adjustment during leap years and facilitates adjustment thereof at the time that the battery is changed or the timepiece is repaired.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece having year counter means for producing a signal representative of a leap year and including date counter means adapted to receive a clock pulse having a period of one-day and in response to each said clock pulse received thereby, said date counter means being indexed through a counting cycle from one to at least 31 to thereby produce a date signal representative of the count thereof, and a month counter means for detecting each return of the date counter to a count of one and in response thereto being indexed by a count of one through a counting cycle from one to at least 12 and thereby produce a month signal representative of the count thereof, and control means for receiving said month signal and day signal and when said month signal is representative of a count of two, said control means, in the absence of a leap year signal applied thereto, being adapted to return the date counter means to a count of one in response to detecting when the count of the day counter is changed from 28 to 29, said control means being further adapted, in response to the presence of a leap year signal applied thereto to return the count of the day counter means to one when the count of the date counter means is changed from 29 to 30, the improvement comprising said year counter means including a year counter adapted to be indexed by a count of one through a counting cycle from zero to nine and thereby produce a year signal representative thereof, and a 10-year counter series connected to said year counter for being cycled at least through one odd and one even counting cycle in response to each return of the count of the year counter to zero, and producing a 10-year signal representative of the count thereof, and judging circuit means for receiving said year counting signal and said 10-year counting signal, and in response to detecting one of the year signals having one of a count of zero, four and eight and said 10-year signal having an even count, and the year signal having one of a count of two and six and the 10-year signal having an odd count, applying a leap year signal to said control means.

2. An electronic timepiece as claimed in claim 1, wherein said judging circuit means includes a first gate means coupled to said year counter and to said 10-year counter, and a second gate means coupled to said year counter and 10-year counter, said first gate means being adapted to produce said leap year signal when said 10-year counter produces a signal having an even count, said second gating means being adapted to produce a leap year signal when said 10-year counter produces a 10-year signal having an odd count.

3. An electronic timepiece as claimed in claim 2, and including reset means coupled to said 10-year counter for detecting when the count of same is indexed through at least one even and one odd counting cycle, and in response thereto being adapted to apply a reset signal to said year counter and 10-year counter to thereby reset the count of the year counter to zero and the count of the 10-year counter to one of a predetermined odd and even count.

4. An electronic timepiece as claimed in claim 3, wherein said control means includes date circuit judging means coupled to said date counter means, said date circuit judging means being adapted to apply a reset signal to said date counter means in response to detecting the count of said date counter means being indexed from a count of 31 to a count of 32, to thereby reset the count of the date circuit means to a count of one.

5. An electronic timepiece as claimed in claim 4, and wherein said control means includes month judging means adapted to detect when the count of the month counter is indexed from a count 12 to a count of 13, and in response thereto, apply a reset signal to said month counter means to reset the count thereof to a count of one.

6. An electronic timepiece as claimed in claim 5, wherein said month circuit judging means further includes means for detecting when the count of said month counter is one of a count of four, six, nine and eleven and in response thereto is adapted to apply a 30-day month signal to said date circuit judging means, said month circuit judging means being further adapted to detect when the count of said month counter means is indexed to a count of two and in response thereto apply a less than 30-day month signal to said date circuit judging means, said date circuit judging means having a 30-day judging circuit means adapted to receive said 30-day signal and detect when the count of said date counter means is indexed from a count of 30 to a count of 31, and in response thereto apply a reset signal to said date counter means to reset the count of same to one, said date circuit judging means further including February detecting means for detecting said less than thirty-day signal, and in the absence of a leap year signal applied thereto, being adapted to apply a reset signal to said date counter means in response to detecting the count of said date counter means being indexed from a count of 28 to a count of 29.

7. An electronic timepiece as claimed in claim 6, and including gate means disposed intermediate said date circuit judging means and said month counter means, said gate means being adapted to gate said reset signal to said month counter means when same is applied to reset said date counter means, and thereby index the count of said month counter means by a count of one, and second gate means disposed intermediate said month circuit judging means and said year counter, for gating said reset signal to said year counter and thereby index same by a count of one in response to the reset signal being applied to the month counter means to reset the count thereof to one.

8. An electronic timepiece as claimed in claim 7, and including a third gate means adapted to receive said clock pulse having a period of one-day and effect gating of same to the input of said date counter means to index the count of said date counter means by a count of one in response to each clock pulse applied thereto.

9. An electronic timepiece as claimed in claim 8, wherein each of said first, second and third gate means includes as a second input, a gating signal, said gating signal being adapted to inhibit the application of a signal to the respective counter means to which same is coupled during correction of the counters.

10. An electronic timepiece as claimed in claim 2, wherein said timepiece includes an hours, minutes and seconds counter for producing timekeeping signals representative of hours, minutes and seconds, display means for displaying one of a time-keeping display in response to said timekeeping signals being applied thereto and a calendar display in response to the signals produced by the date, month and year counter means being applied thereto, and selector means disposed intermediate said timekeeping display means and calendar display means for selectively applying one of said timekeeping signals and calendar display signals to said display means.

11. An electronic timepiece as claimed in claim 10, wherein said digital display means includes flicker means, said flicker means being adapted to selectively flicker predetermined digits of time displayed when the timepiece is disposed in a time-keeping mode by the selector circuit applying timekeeping signals to the digital display means, and flickering calendar digits to be corrected when the timepiece is in a calendar display mode in response to the selector circuit applying calendar signals to said digital display means.

12. An electronic timepiece as claimed in claim 11, and including control circuit means coupled to said hours, minutes and seconds counter means and to said day, month and year counter means, said control circuit means being further coupled to said selector means and said flicker circuit means, and three manually operated switch means coupled to said control circuit means, said first manually operated switch means, being adapted to select one of a locked condition and an unlocked condition, said locked condition preventing correction of the count of said hours, minutes and seconds counter means and said day, month and year counter means, said second manually operated switch means being adapted to select between a calendar display mode and a timekeeping display mode when said first manually operated switch means is in a locked condition.

13. An electronic timepiece as claimed in claim 12, wherein said flicker circuit means is energized in response to said first manually operated switch being disposed in an unlocked position, said flicker circuit being adapted to be indexed by a count of one in response to each actuation of said second manually operated switch when said first manually operated switch means is in an unlocked condition, and thereby effect flickering of a different hours, minutes and seconds counter and day, month and year counter having the time counted thereby being displayed.

14. An electronic timepiece as claimed in claim 13, wherein said third manually operated switch means is adapted to index the count of said counter having the count thereof flickered, to thereby advance the count thereof by a count of one.

* * * * *